US006185881B1

(12) United States Patent
Olberding et al.

(10) Patent No.: US 6,185,881 B1
(45) Date of Patent: Feb. 13, 2001

(54) METHOD AND APPARATUS FOR REINFORCING A DOOR ASSEMBLY

(75) Inventors: Ronald E. Olberding, Kansas City, MO (US); David W. Allen, Overland Park, KS (US)

(73) Assignee: Edward Wayne, Inc., Overland Park, KS (US)

( * ) Notice: Under 35 U.S.C. 154(b), the term of this patent shall be extended for 0 days.

(21) Appl. No.: 09/272,074

(22) Filed: Mar. 18, 1999

(51) Int. Cl.[7] ..... E06B 1/04

(52) U.S. Cl. ..... 52/204.1; 52/210; 52/656.4; 52/656.6; 52/730.3; 52/207

(58) Field of Search ..... 52/204.1, 210, 52/729.5, 739.1, 656.4, 309.2, 730.3; 49/462, 504, 394; 292/340

(56) References Cited

U.S. PATENT DOCUMENTS

| | | | | |
|---|---|---|---|---|
| D. 259,856 | | 7/1981 | Ciener . | |
| D. 283,299 | | 4/1986 | Mazie . | |
| D. 313,162 | | 12/1990 | Westphal et al. . | |
| D. 351,781 | | 10/1994 | DeWitt . | |
| 0,600,865 | | 3/1898 | Groves . | |
| 2,316,425 | | 4/1943 | Hasenburger et al. . | |
| 2,541,871 | * | 2/1951 | Heijmer et al. | 49/399 |
| 3,504,465 | | 4/1970 | Brinker . | |
| 3,800,489 | * | 4/1974 | Boice | 52/208 |
| 3,899,259 | * | 8/1975 | Boice | 403/405.1 |
| 3,918,207 | | 11/1975 | Aliotta . | |
| 3,940,900 | * | 3/1976 | Russo | 52/656 |
| 4,167,088 | * | 9/1979 | Governale | 52/207 |
| 4,171,836 | * | 10/1979 | Aubin | 292/341.18 |
| 4,214,405 | * | 7/1980 | Chupik | 49/382 |
| 4,223,494 | | 9/1980 | Wendt . | |
| 4,389,817 | | 6/1983 | Olberding . | |
| 4,489,517 | * | 12/1984 | Young | 49/382 |
| 4,635,399 | | 1/1987 | Gehrke et al. . | |
| 4,770,452 | | 9/1988 | Petree, Jr. . | |
| 4,858,384 | | 8/1989 | Blankenship . | |
| 4,953,901 | | 9/1990 | Hegdahl . | |
| 5,011,215 | * | 4/1991 | Kalina | 296/146.1 |
| 5,016,930 | | 5/1991 | Hamilton . | |
| 5,031,946 | | 7/1991 | Yarrow . | |
| 5,070,650 | * | 12/1991 | Anderson | 49/460 |
| 5,094,489 | | 3/1992 | Jones . | |
| 5,127,690 | | 7/1992 | Kim et al. . | |
| 5,171,050 | | 12/1992 | Mascotte . | |
| 5,241,790 | | 9/1993 | Schimpf . | |
| 5,365,697 | * | 11/1994 | Vanderpan | 49/380 |
| 5,456,507 | | 10/1995 | Jones . | |
| 5,474,347 | | 12/1995 | Vigneault et al. . | |
| 5,566,509 | * | 10/1996 | Long | 49/462 |

(List continued on next page.)

OTHER PUBLICATIONS

Don–Jo Manufacturing, Inc. Catalog entitled "Lock Accessories" (Sep., 1992).

*Primary Examiner*—Christopher T. Kent
*Assistant Examiner*—Jennifer I. Thissell
(74) *Attorney, Agent, or Firm*—Hovey, Williams, Timmons & Collins

(57) ABSTRACT

A fenestration product includes a door assembly having a door shiftable into and out of a closed position, at least one generally flat door jamb presenting an inner face that faces inwardly toward the door when the door is in the closed position and a generally oppositely facing outer face, and door hardware positioned along the inner face of the door jamb and configured to associate the door with the door jamb. The product further includes a substantially flat reinforcement plate secured flatly against the outer face of the door jamb. Moreover, the door hardware has at least a portion thereof that is securely fastened to the reinforcement plate so that movement of the hardware relative to the door jamb and reinforcement plate is prevented. A method of reinforcing a fenestration product in this manner is also disclosed.

20 Claims, 5 Drawing Sheets

U.S. PATENT DOCUMENTS

| | | | | |
|---|---|---|---|---|
| 5,566,995 | | 10/1996 | Jagiela . | |
| 5,619,823 | | 4/1997 | Ruff et al. . | |
| 5,645,330 | * | 7/1997 | Artwohl et al. | 312/116 |
| 5,647,172 | | 7/1997 | Rokicki . | |
| 5,727,349 | | 3/1998 | McLaughlin . | |
| 5,752,728 | | 5/1998 | Matouschek . | |
| 5,757,269 | | 5/1998 | Roth et al. . | |
| 5,836,628 | | 11/1998 | Beier . | |
| 5,934,024 | | 8/1999 | Simpson . | |

* cited by examiner 24
22
16
30
10
14
32
62
38
12
34
36
20
18
86
88
64
26
68
56
58
60
55
54
70
50
52
42
66
28
40

10
142
110
38
112
12
144
114
144
140
116
132
118
104
92
102
98
90
62
88
96
100
36
114
94
134
126
34
120
68
116
118
122
110
98
86
64
114
96
104
118
124
102
116
120
136
94
122
70
98
100
76
90
96
94
128
92
114
110
116
118
66
104
102
112
138
98
100
96
94
92
40
90
130

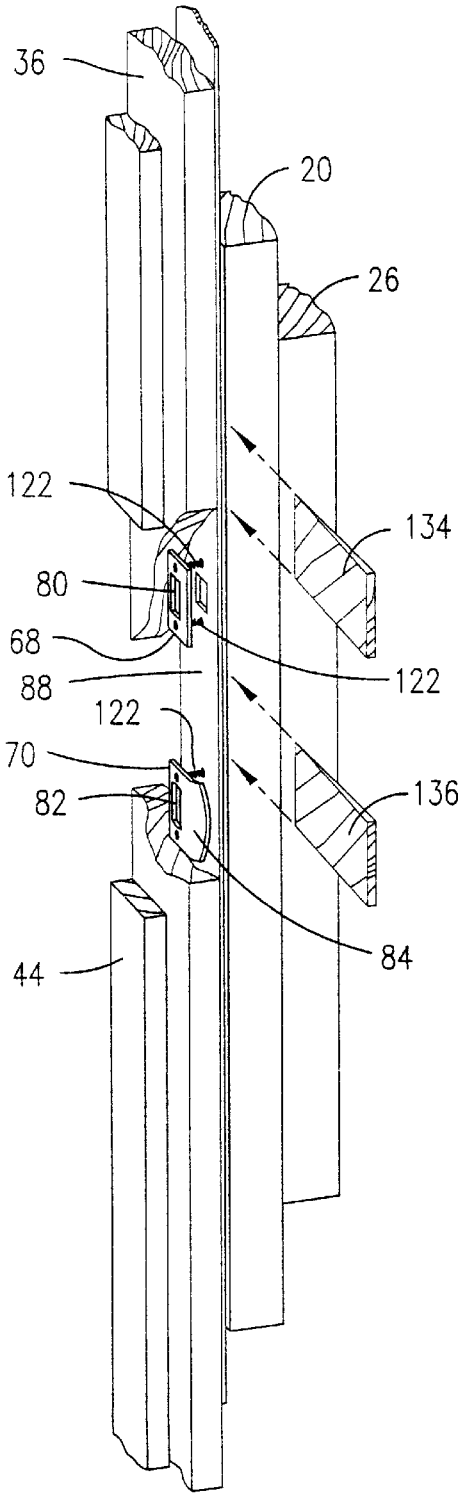
Fig. 3.
Fig. 4.
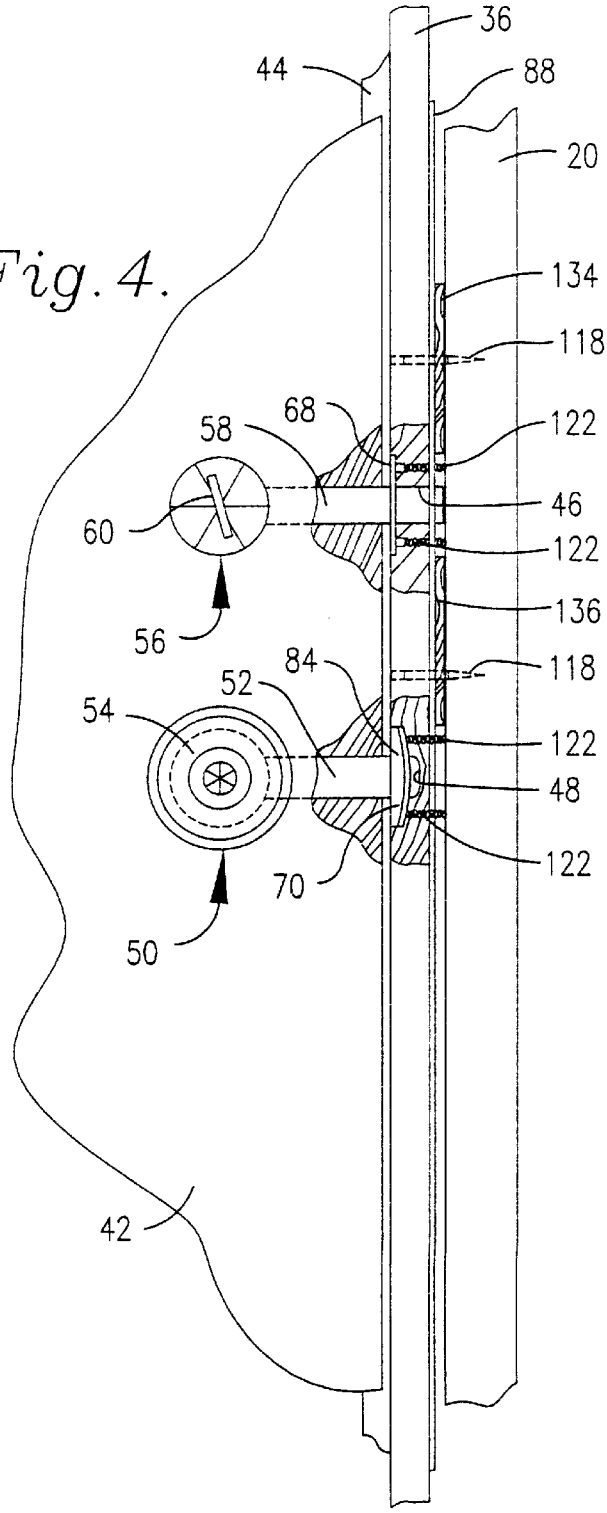

Fig. 5.
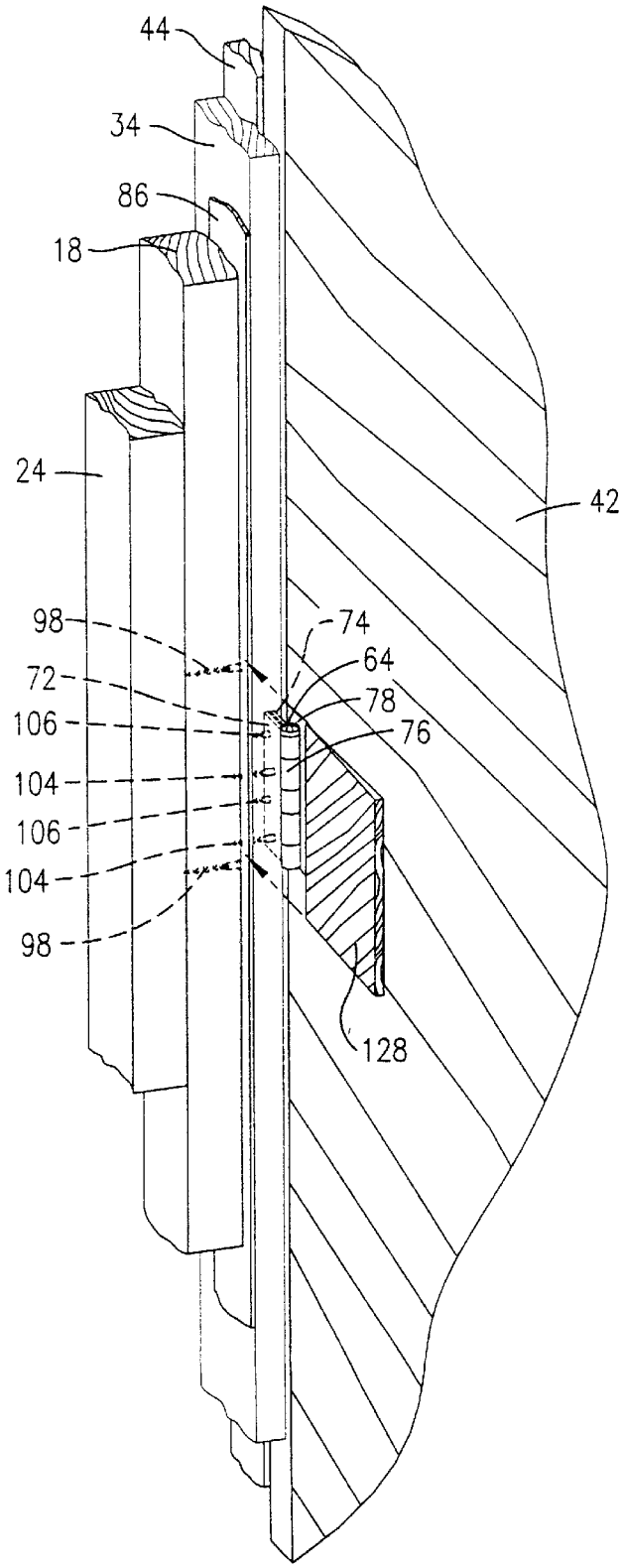
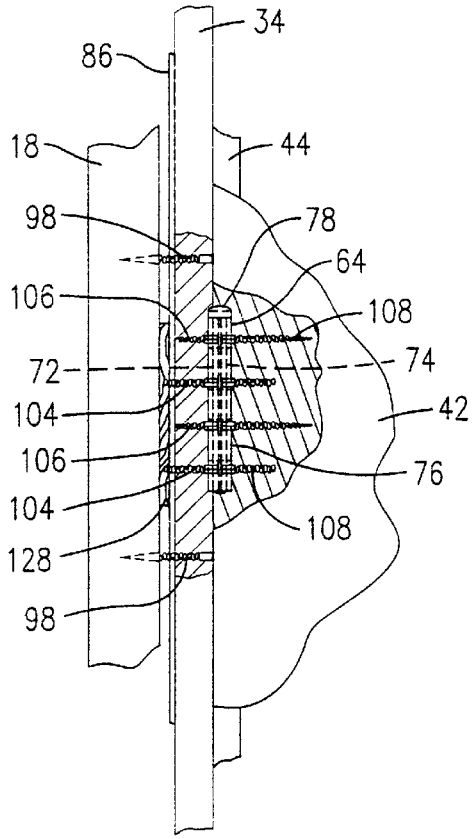
Fig. 6.

METHOD AND APPARATUS FOR REINFORCING A DOOR ASSEMBLY

BACKGROUND OF THE INVENTION

1. Field of the Invention

The present invention relates generally to fenestration products, such as a door assembly, for installation into a building. More particularly, the present invention concerns a reinforced fenestration product design that utilizes standard door hardware but still reduces the risk of intrusion through the product.

2. Discussion of Prior Art

The security of a building is highly dependent on the ability of an exterior door assembly to withstand large impact loads exerted against the outside of the door. This has previously been identified in our co-pending applications for U.S. Letters Patent Ser. No. 08/864,547, filed May 28, 1997, entitled REINFORCED FENESTRATION PRODUCT; U.S. Ser. No. 09/136,990, filed Aug. 20,1998, entitled REINFORCEMENT MEMBER FOR A FENESTRATION PRODUCT; U.S. Ser. No. 09/137,023, filed Aug. 20, 1998, entitled METHOD OF REINFORCING A DOOR; and U.S. Ser. No. 09/128,517, filed Aug. 3, 1998, entitled IMPROVED STRIKE PLATE FOR A DOOR ASSEMBLY; all of which are assigned of record to the assignee of the present application. It is noted that these prior applications disclose various inventions that improve the security provided by a fenestration product. As particularly indicated in the '517 application, there is still a risk of intrusion through a conventional door assembly, even though one or both of the door jambs has been reinforced. Specifically, it has been determined that a large impact load exerted against the exterior side of the door may cause the door latch bolt and lock bolt to fail (e.g., bend). This is believed to be attributable to the fact that a conventional door assembly will often require the distal ends of the latch bolt and, more importantly, the lock bolt to resist movement of the door when a large impact load is exerted against the exterior side of the door. There will consequently be a large moment experienced by the bolts, and they therefore have a tendency to fail (e.g., bend) under these conditions.

OBJECTS AND SUMMARY OF THE INVENTION

Responsive to these and other problems, an important object of the present invention is to provide an improved fenestration product that reduces the risk of intrusion therethrough. It is also an object of the present invention to provide an inexpensive and simple method of reinforcing a fenestration product. It is particularly an important object of the present invention to provide a reinforced fenestration product designed to prevent intrusion therethrough, without requiring new door latch or lock designs. In this respect, an important object of the present invention is to provide a fenestration product that is designed to prevent the door latch bolt and lock bolt from experiencing large moments when an impact load is exerted against the exterior side of the door. Another important object of the present invention is to provide such a fenestration product, with the product utilizing standard door hardware.

In accordance with these and other objects evident from the following description of the preferred embodiment, the present invention concerns a door assembly including a generally flat door jamb that presents an inwardly facing inner face and a generally oppositely facing outer face. A reinforcement plate is secured flatly against the outer face of the door jamb. Moreover, the door hardware (e.g., hinges and/or strike plates) positioned along the inner face of the door jamb are fastened to the reinforcement plate so that movement relative to the reinforcement plate and door jamb is prevented.

It is believed that this inventive arrangement essentially prevents dislodgement of standard door hardware when an impact load is exerted against the exterior side of the door. That is to say, the standard door hardware on the reinforced door assembly does not become the weak point of the product. This not only serves to reinforce the jamb to which the hardware is attached, but it also significantly reduces the risk of intrusion often associated with standard hardware failure. With particular respect to the strike plate, it has been determined that the inventive arrangement substantially decreases the moment experienced by the door latch bolt and lock bolt when a large impact load is exerted against the exterior side of the door, whereby failure of the door lock and door latch is virtually eliminated. In other words, because the strike plate is retained in the intended location, the door latch bolt and lock bolt resist movement of the door (e.g., when a large impact load is exerted against the exterior side of the door) generally at their respective bases (i.e., at a point along their respective lengths adjacent the side of the door), rather than adjacent their distal ends, as particularly described in the '517 application.

If desired, a sidelight assembly may be associated with the door assembly, with one of the window jambs being connected to the door jamb in such a manner that the reinforcement plate is located between the adjacent window and door jambs. The present invention is also concerned with an inventive method of reinforcing a door assembly, wherein the door hardware is fastened to the reinforcement plate secured flatly against the outer face of the door jamb.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein:

FIG. 3 is an enlarged, fragmentary perspective view of the strike side of the fenestration product when installed, particularly illustrating the preferred shimming being exploded away from the remaining components and the strike plates being fastened to the reinforcement plate;

FIG. 4 is a fragmentary elevational view of the interior side of the fenestration product when installed, with parts being sectioned to illustrate the strike plates associating the door with the door jamb and being fastened to the reinforcement plate;

FIG. 5 is a enlarged, fragmentary perspective view of the hinge side of the fenestration product when installed, particularly illustrating the preferred shimming being exploded away from the remaining components and the hinge being fastened to the reinforcement plate;

FIG. 6 is a fragmentary elevational view of the interior side of the fenestration product when installed, with parts being sectioned to illustrate the hinge associating the door with the door jamb and being fastened to the reinforcement plate;

Figure 8:
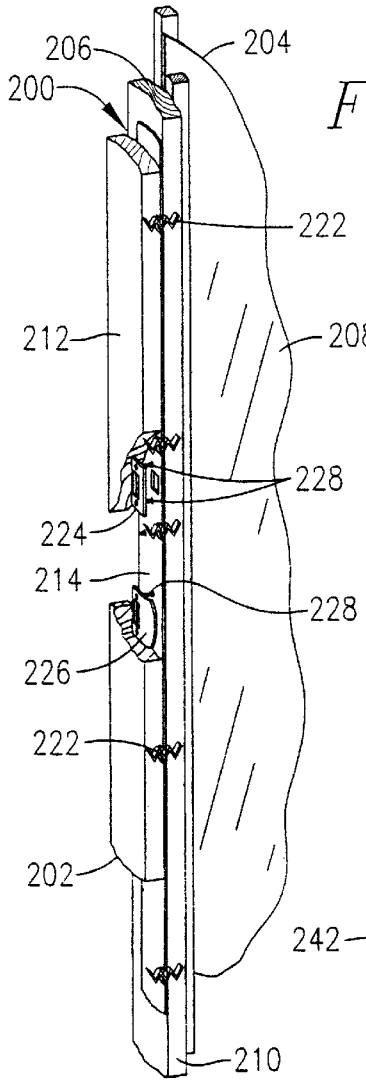
Figure 9:
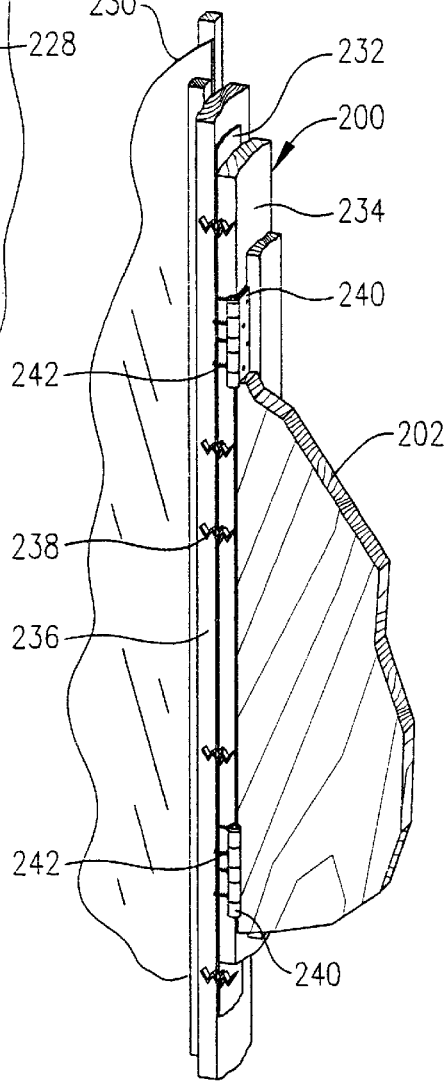

FIG. 8 is a fragmentary perspective view of the alternative fenestration product assembled with the door assembly and sidelight assembly, particularly illustrating the strike plates being fastened to the reinforcement plate; and FIG. 9 is a fragmentary perspective view of the alternative fenestration product assembled with the door assembly and the second sidelight assembly, particularly illustrating the reinforcement plate located between the window jamb and the hinge side door jamb.

DETAILED DESCRIPTION OF THE PREFERRED EMBODIMENTS

Figure 1:
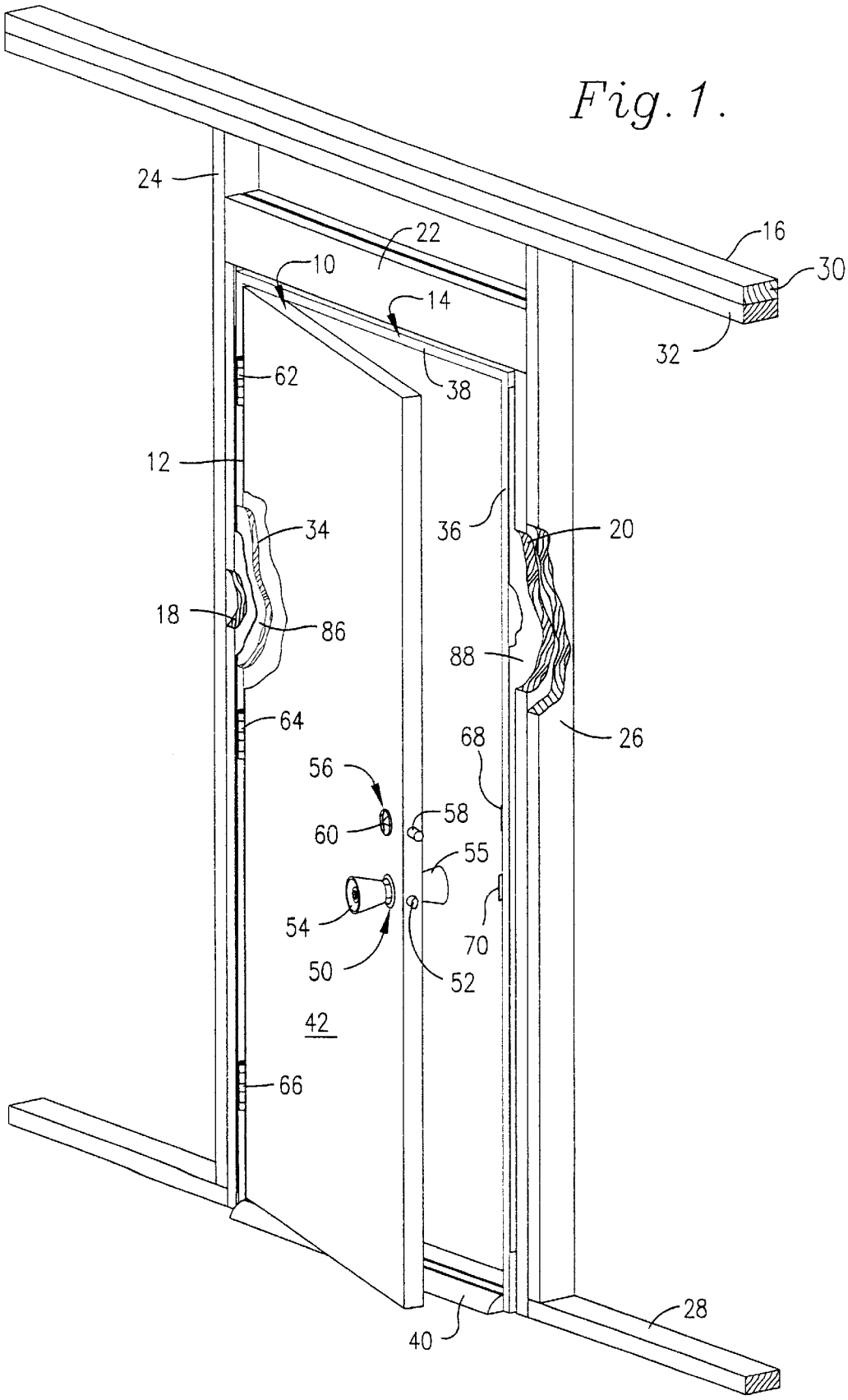
FIG. 1 is a fragmentary perspective view of a fenestration product constructed in accordance with the principles of the present invention, particularly illustrating the product installed in a traditional opening in the structural framework of a building.

Turning initially to FIG. 1, the first fenestration product 10 selected for illustration generally comprises a door assembly 12 designed to be installed within the traditional opening 14 defined by abuilding framework 16. Inparticular, the traditional opening 14 is cooperatively defined by a pair of laterally spaced cripple studs 18 and 20, the sub-floor (not shown), and a header 22. As is customary, the cripple studs 18 and 20 are traditionally formed of wooden planks referred to as "two-by-fours", the sub-floor is formed of plywood or pressboard supported on suitable joists (not shown), and the header is formed by a pair of attached wooden planks referred to as "two-by-sixes". The header 22 is typically supported between a pair of laterally spaced wall studs 24 and 26 extending between the base plate 28 and top plates 30 and 32. It is noted that the studs 24,26 and plates 28,30,32 are all typically formed of two-by-fours. The cripple studs 18 and 20 are fixed to the wall studs 24 and 26 along the respective interior sides thereof and extend from the sub-floor to the header 22.

Those ordinarily skilled in the art will appreciate that the illustrated framework 16 has been provided for illustrative purposes only. That is, it is entirely within the ambit of the present invention to install the fenestration product 10 in buildings having various other constructions. Moreover, it shall be understood that the term "building" as used herein means any structure having an area which may be accessed through a door assembly (e.g., houses, multi-dwelling structures, commercial structures, etc.).

Figure 2:
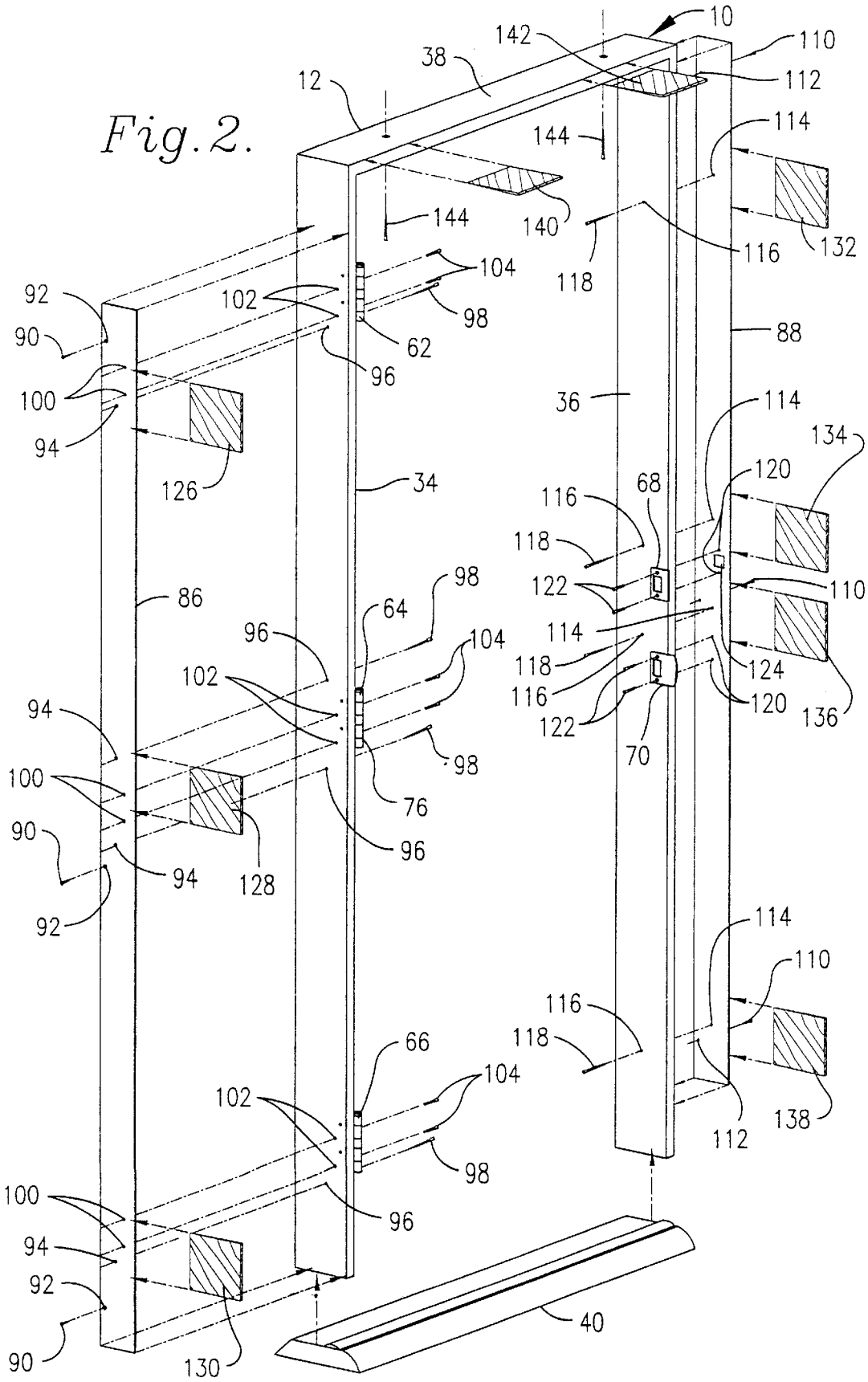
FIG. 2 is an exploded perspective view of the fenestration product, with the door being removed and particularly illustrating the shimming preferably used with the product.

With the foregoing caveat in mind, the illustrated door assembly 12 includes an open framework comprising a pair of laterally spaced flat door jambs 34 and 36 extending between the sub-floor and header 22, an upper cross-beam 38 fixed between the upper ends of the jambs 34 and 36 to be located adjacent the header 22 when the product is installed, and a sill 40 extending between the lower ends of the jambs 34 and 36 for attachment to the sub-floor (see FIG. 2). The jambs 34,36 and cross-beam 38 are illustrated as an integral, seamless body, although it will be appreciated that these components are normally separate pieces of material that are interconnected by suitable means, such as screws. It is noted that the illustrated door framework is formed of wood, as this is the material most commonly used and most susceptible to failure when a large impact load is exerted against the exterior side of the assembly.

The door assembly 12 further includes a door 42 swingably mounted to the jamb 34, with the door 42 being configured to fit within the framework when swung to a closed position (see FIGS. 4 and 5). A stop 44 extends along the inner faces of the jambs 34,36 and crossbeam 38 for preventing, among other things, outward swinging movement of the door 42 beyond its closed position. The stop 44 traditionally comprises wood planks having a width that is less than that of the jambs 34,36 and crossbeam 38. The illustrated stop 44 is mounted flush with the exterior side of the jambs 34,36 and crossbeam 38 and is dimensioned so that the interior side of the door 42 lies flush with the interior side of the jambs 34,36 and crossbeam 38 when the door 42 is closed.

The door jamb 36 is provided with a pair of vertically spaced bolt-receiving holes 46 and 48. In the usual manner, the door 42 is provided with a latch mechanism 50 having a bolt 52 that is yieldably urged outwardly to be automatically inserted into the lower hole 48 when the door 42 is closed, whereby the latch bolt 52 serves to releasably retain the door 42 in the closed position. Rotatable interior and exterior handles 54 and 55 are operably coupled with the latch bolt 52 to retract the latter into the door 42 and out of the hole 48 when it is desired to swing the door 42 out of the closed position. The door 42 further includes a lock mechanism 56 for securely locking the door 42 in its closed position. Similar to the latch mechanism 50, the lock mechanism 56 is provided with a reciprocating bolt 58 that is shiftable into and out of the upper jamb hole 46, although it is noted that the lock bolt 58 has a relatively longer throw than the latch bolt 52 (see FIG. 4) and the lock bolt 58 is typically not automatically extended out of the door 42. As is customary, the lock bolt 58 is shifted between the locked and unlocked positions by an interior hand-operated turn screw 60, as well as by a key-operated cylinder (not shown) on the exterior side of the door 42.

In the usual manner, the door assembly 12 includes various hardware for associating the door 42 with the door jambs 34 and 36. As will subsequently be described, the door hardware preferably has a standard and conventional construction, however, it is not susceptible to the problem of dislodgement often associated with traditional door assemblies. The hardware of the illustrated door assembly 12 includes three hinges 62,64,66 and a pair of strike plates 68 and 70. In the usual manner, the hinges 62,64,66 serve to swingably mount the door 42 on the jamb 34, while the strike plates 68,70 serve to, among other things, reinforce the jamb 36 in the vicinity of the bolt-receiving holes 46,48.

With particular respect to the hinges 62–66, this hardware has a universal construction, and it is consequently sufficient to describe only one of the hinges with the understanding that the remaining hinges are similarly constructed. As shown in FIGS. 5 and 6, the intermediate hinge 64 includes relatively swingable first and second plates 72 and 74 that are fixed relative to the door jamb 34 and door 42, respectively. As is customary, each of the plates 72 and 74 have spaced apart tubular sections, whereby the plates 72 and 74 cooperatively present a sleeve 76 configured to receive a pin 78 therein. In addition, each of the plates 72 and 74 are provided with a series of screw-receiving openings configured to receive suitable fasteners for mounting the plates 72 and 74, as set forth hereinbelow. If desired, the jamb 34 and door 42 may be provided with recesses configured to snugly receive the respective plates 72 and 74.

As perhaps best shown in FIGS. 3 and 4, the upper strike plate 68 comprises a generally flat body having a bolt-receiving opening 80 defined therein. The strike plate 68 is positioned along the inner face of the jamb 36 in such a location that the bolt receiving opening 80 is aligned with the hole 46 defined in the jamb 36. If desired, the strike plate 68 may be recessed in the jamb 36, as shown in FIG. 4. It is noted that the shape and size of the bolt-receiving opening 80 corresponds with that of the lock bolt 58 in such a manner that movement of the bolt 58 in a direction transverse to its longitudinal axis is significantly limited by the plate 68, when the bolt 58 is received in the opening 80. In fact, the strike plate 68 may be designed so that the lock bolt 58 is slidably received within the opening 80. It will be appreciated that the relative shapes and sizes of the lock bolt 58 and opening 80 may vary to some degree, although it is important that the plate 68 be configured to prevent virtually any movement of the bolt in a direction corresponding to opening of the door 42, which is customary. Similar to the lock strike plate 68, the latch strike plate 70 comprises a generally flat body having a bolt receiving opening 82 that is aligned with the hole 48 in the jamb 36 and that has a shape and size preferably corresponding to that of the latch bolt 52. However, the latch strike plate 70 is provided with a cam element 84 that projects from the interior side of the body. In the usual manner, the cam element 84 is designed to engage the latch bolt 52 and cause the same to retract, as the door 42 is closed. It is noted that both strike plates 68 and 70 are provided with screw-receiving holes spaced above and below the respective bolt-receiving openings 80 and 82.

A pair of reinforcement plates 86 and 88 are associated with respective ones of the door jambs 34 and 36. The plates 86 and 88 are similar to the reinforcement structure shown in the '547, '990 and '023 applications, which are incorporated by reference herein. Not only do the plates 86 and 88 afford the advantages identified in these applications, they also provide a strong anchoring point for the door hardware, as will subsequently be described.

Turning first to the hinge side reinforcement plate 86, this component comprises a flat, rectangular body that fits conveniently in the normal space provided between the cripple stud 18 and door jamb 34. The plate 86 is preferably formed of an approximately ⅛ inch thick piece of aluminum. The illustrated plate 86 has a length of approximately seventy-six inches and a width of approximately three inches. Although the plate 86 is shorter and narrower than the illustrated door jamb 34, it will be appreciated that the preferred dimensions fit virtually all door jamb sizes. That is to say, the plate 86 is dimensioned so that it does not project beyond the boundaries of a traditional door jamb. In addition, the preferred plate length ensures that the plate 86 will extend substantially the full length of virtually any door jamb. If desired, the plate 86 may alternatively be dimensioned to be coextensive with the door jamb 34. In any case, the reinforcement plate 86 is secured flatly against the outer face of the door jamb 34, preferably with the lower ends and interior sides of the jamb 34 and plate 86 being flush. In the illustrated embodiment, the plate 86 is initially secured to the jamb 34 by three mounting screws 90 that are received in respective openings 92 defined in the plate 86 and threaded into the jamb 34. The screws 90 are preferably countersunk in the plate 86 and may comprise standard one inch wood screws. The reinforcement plate 86 is further provided with four longitudinally spaced attachment screw openings 94. Preferably, the reinforcement plate 86 is used as a template to form by suitable means, such as drilling, the openings 96 in the jamb 34. Each set of aligned openings 94 and 96 is configured to received an attachment screw 98 therein. As perhaps best shown in FIGS. 5 and 6, the attachment screws 98 have sufficient length to pass through the jamb 34 and plate 86 and then thread into the adjacent cripple stud 18. Of course, the attachment screws 98 are inserted during installation of the fenestration product 10 in the building framework 16. The jamb 34 and reinforcement plate 86 also cooperatively present aligned fastening screw openings 100 and 102, respectively. The fastening screw openings 100 and 102 are preferably formed when the hinges 62,64,66 are mounted, although it is entirely within the ambit of the present invention to provide these openings prior to hardware installation.

In particular, the hinges 62,64,66 are positioned along the inner face of the jamb 34 in the illustrated locations, with the positioning of the hinges being facilitated as a result of the recesses formed in the jamb, as noted above. The first plate 72 of each hinge is then preferably used as a template to facilitate formation of the openings 100 and 102, with the openings being formed by suitable means (e.g., drilling). In addition, although the first plate 72 of each of the illustrated hinges 62,64,66 is provided with four screw-receiving openings, each of the first plates is associated with only two sets of aligned openings 100,102. In this respect, it is entirely within the ambit of the present invention to vary the number of sets of aligned openings 100,102 associated with each of the hinges (e.g., the upper hinge 62 maybe associated with three sets of aligned openings 100,102). In any case, a fastening screw 104 is inserted through the first plate 72 of each of the hinges 62,64,66 and into each set of aligned openings 100,102. In the illustrated embodiment, the screw 104 and openings 100,102 are cooperatively designed so that the screw 104 threadably engages the reinforcement plate 86 and jamb 34 along the respective openings 100 and 102. Preferably, the screw 104 comprises a standard thread cutting screw and the openings 100,102 are standard pilot holes dimensioned to receive the screw 104 as it forms the threads in the jamb 34 and reinforcement plate 86. It is noted that the corresponding openings in the first plate 72 of each of the hinges 62,64,66 is relatively larger than the openings 100,102, such that the screw 104 is slidably received within each of these openings. In other words, the illustrated hinges 62,64,66 do not threadably engage the screws 104, although it is entirely within the ambit of the invention to do so. It is also possible to vary the size of the opening 102 defined in the jamb 34 so that the screw 104 is slidably received within the jamb 34 rather than being threadably interengaged therewith.

However, it is important that each of the hinges 62,64,66 be securely fastened to the reinforcement plate 86. Particularly, each of the hinges 62,64,66 is prevented from shifting relative to the plate 86 as a result of the interlocking threaded interengagement of the screws 104 and reinforcement plate 86. The hinges 62,64,66 are otherwise separate and disconnected from the reinforcement plate 86, which consequently permits the use of standard hinges in the door assembly 12. It is noted that the reinforcement plate 86 is particularly well suited for use with the thread cutting screws 104 as a result of the plate 86 being formed of metal, such as the preferred aluminum material. Moreover, the principles of the present invention are equally applicable to various other arrangements for securely fastening standard hinges to the reinforcement plate 86. For example, the reinforcement plate 86 may be provided with a previously internally threaded opening that is configured to receive an externally threaded bolt, with such an arrangement likewise benefitting from the reinforcement plate being formed of metal.

As shown in FIGS. 5 and 6, the first plate 72 of each of the hinges 62,64,66 is further secured to the door jamb 34 by relatively short screws 106 received within the remaining openings of the first plate 72. As is customary, the second plate 74 of each of the hinges 62,64,66 is fixed to the door 42 by screws 108, which may vary in length as shown.

The strike plate side reinforcement plate 88 is similar in design and function to the hinge side reinforcement plate 86. Thus, it shall be sufficient to explain that the strike plate side reinforcement plate 88 is secured against the outer face of the jamb 36 by mounting screws 110 received within respective openings 114 defined in the plate 88 (see FIG. 2). The strike plate side reinforcement plate 88 further includes a series of attachment screw openings 94 that are preferably used in forming aligned openings 116 in the jamb 36. Each set of openings 114,116 receive an attachment screw 118 that is threaded into the adjacent cripple stud 20 when the product 10 is installed within the building framework (see FIG. 4). Moreover, the jamb 36 and reinforcement plate 88 include aligned fastening screw openings 120 (only the openings being shown in the reinforcement plate) that are formed by suitable means, such as drilling, preferably using the strike plates 68 and 70 as templates. A plurality of fastening screws 122, which preferably comprise standard thread cutting screws, are slidably received within the openings of the strike plates 68 and 70 and threadably engage the door jamb 36 and reinforcement plate 88 along the aligned openings 120 (see also FIGS. 3 and 4). Again, the foregoing arrangement provides advantages, and may have constructional variations, similar to those noted above with respect to the hinge side reinforcement plate 86. For example, the foregoing arrangement permits standard strike plates to be securely fastened to the reinforcement plate 88. It is also noted that the strike plate side reinforcement plate 88 is provided with a bolt-receiving opening 124 that is configured to receive the outermost end of the lock bolt 58 when the door is locked 42 in the closed position.

The inventive method of reinforcing the door assembly 12 should be apparent from the previous description. It is therefore sufficient to explain that the reinforcement plates 86 and 88 are first placed against the outer faces of the respective door jambs 34 and 36. It may be necessary to shift the plates 86 and 88 along the outer faces of the respective jambs 34 and 36 until certain openings and/or edges are aligned. For example, the lower end and interior side of the hinge side reinforcement plate 86 are positioned generally flush with the corresponding end and side of the jamb 34, in the illustrated embodiment. On the other hand, the bolt-receiving opening 124 and interior side of the strike plate side reinforcement plate 88 are respectively aligned with the bolt-receiving hole 46 and interior side of the jamb 36. The reinforcement plates 86 and 88 are then secured to the jambs 34 and 36 by the mounting screws 90 and 110, respectively. The attachment screw openings 96 and 116 are then formed in the jambs 34 and 36, using the openings 94 and 114 in the reinforcement plates 86 and 88 as templates. In most instances, the previous steps would be performed at the mill or factory, although it is entirely within the ambit of the present invention to perform all of the steps in the field (i.e., at the building construction site) or at the factory. In any case, the product 10 is then preferably set within the opening 14 of the building framework 16. This may require temporary attachment of the door framework to the building framework, such as by nailing the former to the latter, and the door assembly 12 is shimmed within the opening 14. In the illustrated embodiment, shims 126,128,130 are wedged into the spaced defined between the cripple stud 18 and reinforcement plate 86, with each of the shims being vertically aligned with a respective one of the hinges (see FIGS. 2, 5 and 6). On the opposite side, shims 132,134,136,138 are wedged between the cripple stud 120 and reinforcement plate 88, with each of these shims being generally vertically aligned with one of the attachment screws 118. Two shims 140 and 142 are preferably wedged between the header 22 and cross-beam 38, with a pair of attachment screws 144 being provided to securely fasten the cross-beam 38 to the header 22. At this point, the door hardware (i.e., the hinges 62,64,66 and strike plate 68,70) is preferably installed. As noted above, the preferred method involves first forming pilot holes in the respective door jamb and reinforcement plate using the door hardware as a template. The fastening screws 104 or 122 are subsequently inserted through the corresponding hardware and then threaded into the respective door jamb and reinforcement plate. Of course, attachment of the door hardware need not occur after the door assembly 12 has been set in the building framework 16, but rather such attachment may occur as soon as the reinforcement plates 86 and 88 have been mounted to the respective door jambs 34 and 36. Finally, the product 10 is securely attached to the building framework 16 by installing the attachment screws 98,118,144.

It will be appreciated that this installation virtually eliminates intrusion that might otherwise be achieved by exerting a large impact load on the exterior side of the door 42. Not only is the door framework, especially the jambs 34 and 36, reinforced, but the standard door hardware is securely mounted so as not to be dislodged during such an intrusion. With particular respect to the strike plates 68 and 70, the latch bolt 52 and lock bolt 58 are not required to resist movement of the door 42 outfits closed position solely at their respective outermost ends. Instead, the strike plates 68 and 70 engage the lock bolt 58 and latch bolt 52, respectively, much closer to the door 42 to which the bolts are mounted. The moments experienced by the bolts 52 and 58 is consequently not likely to cause failure (e.g., bending of the bolts 52 and 58).

Figure 7:
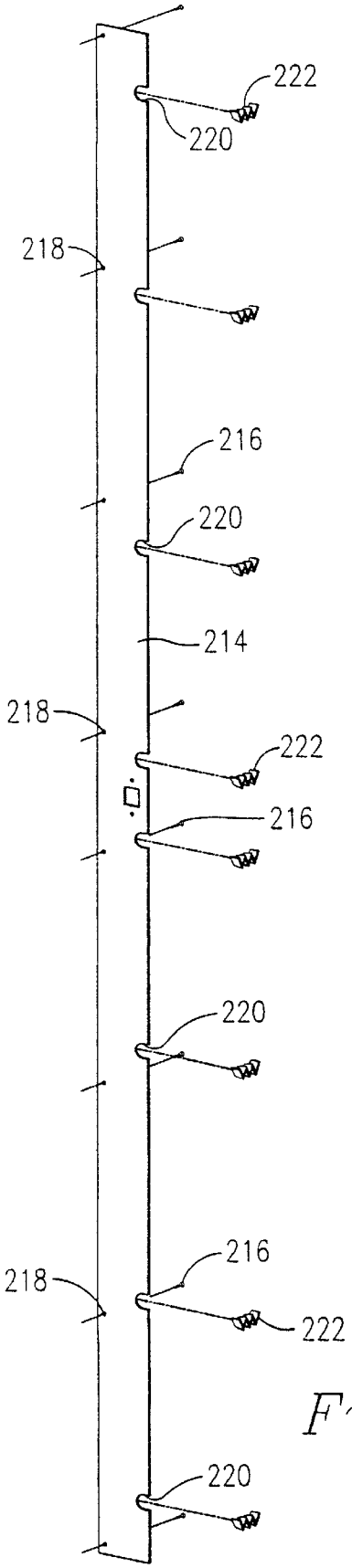
FIG. 7 is a perspective view of an alternative reinforcement plate configured for use in a fenestration product including a door assembly and sidelight assembly, particularly illustrating the fastener-receiving openings in the reinforcement plate and the various fasteners used to secure the plate to the door jamb and to interconnect the adjacent door and window jambs.

The principles of the present are equally applicable to various other fenestration product designs. For example, FIGS. 7 and 8 depict a fenestration product 200 including door assembly 202 and an adjacent sidelight assembly 204. In the usual manner, the sidelight assembly 204 includes framework 206 for supporting a window 208, with the framework 206 including a jamb 210 positioned alongside the adjacent door jamb 212. The reinforcement plate 214 is consequently located between the adjacent window and door jambs 210,212. Similar to the previous embodiment, the reinforcement plate 214 is secured to the outer face of the door jamb 212 by mounting screws 216 inserted through respective openings 218 spaced along the length of the plate 214. In addition, the interior side of the reinforcement plate 214 is provided with a series of spaced apart semicircular slots 220, each of which is configured to receive a corrugated staple 222 therein. In this respect, the reinforcement plate 214 is preferably secured to the outer face of the door jamb 212, and the window jamb 210 is then placed alongside the door jamb 212 and connected thereto by the staples 222. Similar to the previously described embodiment, the strike plates 224 and 226 are securely fastened to the reinforcement plate 214 by suitable fasteners 228, which may also threadably interengage the door jamb 212 and window jamb 210 if desired. Although not shown, it will be appreciated that the hinges of the door assembly 202 are securely fastened to a reinforcement plate in a manner similar to the previously described embodiment. It is also noted that the fenestration product 200 may be provided with a second sidelight assembly positioned adjacent the hinge side of the door assembly 202, with the adjacent window and door jambs being secured to one another in a manner similar to that described with respect to the present embodiment.

Such an arrangement is shown in FIG. 9, wherein the fenestration product 200 is provided with a second sidelight assembly 230 along the hinge side of the door assembly 202. As indicated, a reinforcement plate 232 is located between the door jamb 234 and the window jamb 236 and the jambs 234 and 236 are interconnected by corrugated staples 238. Furthermore, the hinges 240 (only two being shown in FIG. 9) of the door assembly 202 are securely fastened to the reinforcement plate 232 by suitable fasteners 242. The fasteners 242 may also threadably interengage the door jamb 234 and window jamb 236 similar to the strike side of the door assembly 202.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby states their intent to rely on the Doctrine of Equivalents to determine and assess the reasonably fair scope of the present invention as pertains to any apparatus not materially departing from but outside the literal scope of the invention as set forth in the following claims.

What is claimed is:

1. A fenestration product comprising:

a door assembly including a door and a pair of laterally spaced, generally flat structural door jambs, each of which presents an inner face facing inwardly toward the door when the door is in a closed position and a generally oppositely facing outer face, said door assembly further including door hardware configured to associate the door with the jambs, said door hardware including a strike plate positioned against the inner face of one of the jambs and a hinge positioned against the inner face of the other jamb to swingably mount the door on the other jamb;

a sidelight assembly including a window jamb positioned alongside the outer face an adjacent one of the door jambs, with the window jamb and the adjacent one of the door jambs being interconnected; and a pair of substantially flat reinforcement plates each being secured flatly against the outer face of a respective one of the door jambs, with one of the plates being located between the window jamb and the adjacent one of the door jambs, said strike plate and hinge each having at least a portion thereof that is fastened to a corresponding one of the reinforcement plates, such that said at least a portion thereof is prevented from moving relative to the corresponding one of the reinforcement plates and away from or along the inner face of the respective one of the door jambs.

2. A fenestration product as claimed in claim 1, said at least a portion of the strike plate being fastened to said one of the plates located between the window jamb and the adjacent one of the door jambs.

3. A fenestration product as claimed in claim 1; and a second sidelight assembly, such that the sidelight assemblies are each associated with a respective one of the door jambs, said second sidelight assembly including a second door jamb positioned alongside the outer face of the respective one of the door jambs, said second door jamb and the respective one of the door jambs being interconnected, with the other one of the plates being located therebetween.

4. A fenestration product as claimed in claim 1, said hinge having a pair of relatively swingable plates, one of which is positioned along the inner face of said other door jamb and is fastened to the corresponding one of the reinforcement plates.

5. A fenestration product as claimed in claim 1, said one door jamb including a bolt-receiving hole, said strike plate including a substantially flat body that is positioned flatly against the inner face of said one door jamb and is fastened to the corresponding one of the reinforcement plates, said body having a bolt-receiving opening that is aligned with the bolt-receiving hole in said one door jamb.

6. A fenestration product as claimed in claim 1, each of said reinforcement plates extending along substantially the full length of the respective one of the door jambs.

7. A fenestration product as claimed in claim 1; and at least one fastener projecting through each of the door jambs and interconnecting the corresponding one of the reinforcement plates and said at least a portion of the door hardware to prevent movement of the latter relative to the former.

8. A fenestration product as claimed in claim 7, said at least a portion of the door hardware, the respective one of the door jambs, and the corresponding one of the reinforcement plates having aligned openings that receive said at least one fastener therein.

9. A fenestration product as claimed in claim 8, said at least one fastener comprising a screw, said screw threadably engaging the corresponding one of the reinforcement plates along the opening defined therein.

10. A fenestration product as claimed in claim 9, said screw being slidably received within the opening defined in said at least a portion of the door hardware and threadably engaging the respective one of the door jambs along the opening defined therein.

11. A fenestration product as claimed in claim 10, said screw being configured to form threads in the respective one of the door jambs and the corresponding one of the reinforcement plates as the screw is inserted into the openings defined therein.

12. A fenestration product as claimed in claim 1, each of said reinforcement plates including a plurality of staple-receiving slots; and a plurality of staples, each of which is received within a respective one of the staple-receiving slots and serves to interconnect said at least one window jamb and said adjacent one of the door jambs.

13. A fenestration product as claimed in claim 1, each of said reinforcement plates being formed of metal.

14. A method of reinforcing a fenestration product including a door and a pair of laterally spaced, generally flat structural door jambs, each of which presents an inner face facing inwardly toward the door and a generally oppositely facing outer face, said fenestration product reinforcement method comprising the steps of:

(a) securing a substantially flat reinforcement plate against the outer face of each of the door jambs;

(b) positioning a strike plate and a hinge against the inner face of respective ones of the door jambs;

(c) placing a window jamb alongside the outer face of one of the door jambs so that one of the reinforcement plates is located between the one door iamb and the window jamb;

(d) interconnecting the one door jamb and the window jamb; and (e) fastening at least a portion of the strike plate and the hinge to a corresponding one of the reinforcement plates so that said at least a portion thereof is prevented from moving relative to the corresponding one of the reinforcement plates and away from or along the inner face of the respective one of the door jambs.

15. A fenestration product reinforcement method as claimed in claim 14, step (e) including the step of fastening said at least a portion of the strike plate to said one of the reinforcement plates located between the one doorjamb and the window jamb .

16. A fenestration product reinforcement method as claimed in claim 14;

(f) placing a second window jamb alongside the outer face of the other one of door jambs so that the other one of the reinforcement plates is located between the other door jamb and second window jamb; and (g) interconnecting the other door jamb and second window jamb.

17. A fenestration product reinforcement method as claimed in claim 1; and aligning a bolt-receiving opening in one of the reinforcement plates with a bolt-receiving hole in one of the door jambs before the former is secured to the latter.

18. A fenestration product reinforcement method as claimed in claim 1, step (a) including the steps of inserting a mounting screw through each of the reinforcement plates, respectively, and threading the mounting screw into the respective one of the door jambs.

19. A fenestration product reinforcement method as claimed in claim 1, step (c) including the steps of inserting a fastening screw through the strike plate and the hinge, respectively, and threading the fastening screw into the corresponding one of the reinforcement plates.

20. A fenestration product reinforcement method as claimed in claim 1, step (e) including the step of stapling the window jamb and the one door jamb to one another.

* * * * *